US005132739A

United States Patent [19]

Mauer et al.

[11] Patent Number: 5,132,739

[45] Date of Patent: Jul. 21, 1992

[54] TONER FUSER HAVING AN OFFSET PREVENTING LIQUID APPLYING MEANS AND IMAGE-FORMING APPARATUS FOR USE THEREIN

[75] Inventors: Andrew J. Mauer, Rochester; Borden H. Mills, III, Webster; Catherine D. Newell; Walter B. Sherwood, both of Rochester, all of N.Y.

[73] Assignee: Eastman Kodak Company, Rochester, N.Y.

[21] Appl. No.: 707,514

[22] Filed: May 30, 1991

[51] Int. Cl.[5] ..... G03G 15/20; G03G 21/00

[52] U.S. Cl. ..... 355/284; 355/208; 355/319

[58] Field of Search ..... 355/284, 282, 208, 319; 219/216

[56] References Cited

U.S. PATENT DOCUMENTS 4,429,990 2/1984 Tamary ..... 355/284
4,453,841 6/1984 Bobick et al. .
4,549,803 10/1985 Ohno et al. .
4,568,169 2/1986 Wada et al. .
4,593,992 6/1986 Yoshinaga et al. ..... 355/284
4,908,670 3/1990 Ndebi .
4,920,382 4/1990 Mills et al. .
4,942,433 7/1990 Stuart .

OTHER PUBLICATIONS

Research Disclosure, May 1988, No. 28956, pp. 305-306; "Exposure Scheduling For Improved Frame Utilization And Throughout".

*Primary Examiner*—Joan H. Pendergrass
*Assistant Examiner*—Shuk Lee
*Attorney, Agent, or Firm*—Leonard W. Treash, Jr.

[57] ABSTRACT

An image-forming apparatus is adapted to make duplex copies with a separate pass through the fuser for each side. To prevent fusing oil from contaminating an image member by passage from a first image side of a duplex copy to a transfer drum and, hence, to the image member, an oiling algorithm to prevent or lessen oiling during fusing of the first side of duplex copies is provided. Preferably, the apparatus has a finite duplex return path which can hold a limited number of receiving sheets, which number is small enough that offset does not occur while doing first side-duplex fusing.

13 Claims, 2 Drawing Sheets

TONER FUSER HAVING AN OFFSET PREVENTING LIQUID APPLYING MEANS AND IMAGE-FORMING APPARATUS FOR USE THEREIN

TECHNICAL FIELD

This invention relates to the fusing of toner images. More particularly, this invention relates to the application of an offset preventing liquid to a roller or similar component in a heated roller fuser which forms part of an image-forming apparatus.

BACKGROUND ART

U.S. patent application Ser. No. 07/430,037 to Rodenberg et al, filed Nov. 1, 1989, shows an image-forming apparatus in which a series of electrostatic images are formed on an image member. The electrostatic images are toned by application of toner to form toner images, and the toner images are transferred to a receiving sheet. Each receiving sheet is fed to a fuser where its toner image is fixed. In a duplex mode, from the fuser the sheets are fed along a duplex path back to a position upstream of the transfer station from which they are then fed through the system again to receive a toner image on the opposite side. The sheet is again passed through the fuser to fuse the second image and exits the apparatus with fixed images on both sides.

This apparatus also has the ability to make multicolor images on each side of a receiving sheet. To accomplish this, a plurality of toning stations are provided to tone a series of electrostatic images with different color toners. The receiving sheet is wrapped around a transfer drum at the transfer station and rotated through transfer relation with successive images on the image member which are transferred to the receiving sheet in registration to form a multicolor image.

Once the transfer is completed, the receiving sheet is allowed to follow the image member rather than stay on the transfer drum, and it continues on to the fuser where the multicolor image is fused. As with single color images, the sheet may be returned to receive a single color or multicolor image on its oppoisite side and is again passed through the fuser. To make it easier to separate the transfer sheet from the transfer drum, the surface of the transfer drum is substantially roughened to a point where it has a texture of between 0.002 to 0.005 inches separation between peaks and valleys.

In testing of the above apparatus, it provided high quality images, both single color and multicolor. However, on occasion, some images had an unacceptable amount of background, which background was patterned. This image defect occurred now and then in both simplex and duplex copies, both multicolor and single color, but did not always occur.

Obviously, it became desirable to eliminate this imperfection in the image background.

U.S. Pat. No. 4,429,990, issued Feb. 7, 1984 to E. J. Tamary, shows a pressure roller fuser of the type presently commercially used to fix toner images to support sheets. An important aspect of that disclosure is an applicator for applying release liquid to a fusing roller which contacts the toner image. The applicator, commonly called a rotating wick, includes a hollow, porous roller which is supplied with fusing oil internally. The applicator has an inner supply tube with holes in it and is covered by a porous material having a surface of wool or a heat resistant synthetic wicking material. The applicator is rotatable by the fusing roller. The applicator is movable into and out of engagement with the roller according to a program which prevents excess buildup of oil on the roller, which otherwise would stain the receiving sheet.

U.S. Pat. No. 4,549,803 to Ohno et al, issued Oct. 29, 1985 and U.S. Pat. No. 4,593,922 to Yoshinaga et al, issued Jun. 10, 1986, both show fixing devices in which fixing conditions are changed between paper stock and transparency stock to reduce the amount of oil applied when transparencies are being fixed.

U.S. Pat. No. 4,942,433 to Stuart, issued Jul. 17, 1990, shows a wicking device similar to that shown in the Tamary patent. When transparency stock is being fixed, a brake prevents rotation of the wick by the fuser to reduce the amount of oil applied.

U.S. Pat. No. 4,920,382 to Mills et al, issued Apr. 24, 1990, also shows a wicking device similar to that disclosed in Tamary in which a relatively complicated algorithm is used for transparencies, including feeding a sheet of paper through the fuser between transparencies to reduce and smooth the oil on the fusing roller.

DISCLOSURE OF INVENTION

Applicants have found that the background defect can be cured by adjusting the oiling algorithm used in applying offset preventing liquid in the fuser. According to a preferred embodiment, no oil or less oil is applied when fusing the first image to the receiving sheet when the apparatus is operating in the duplex mode. When operating in the simplex mode or fusing the second image to a sheet, a normal amount of liquid is applied.

Without being restricted to any particular explanation as to why the invention in fact works, applicants' believe that the background defect is caused by oil that has worked its way back through the duplex path to the transfer roller. That is, oil applied to the fuser while fusing the first image in the duplex mode, is transferred to the transfer roller by the receiving sheet when the second image is being transferred to the other side of the receiving sheet. During a time in which the transfer roller is in direct contact with the image member between images or while images are skipped, some of that oil is transferred to the image member in a pattern corresponding to the roughened surface of the transfer roller. This pattern of oil on the image member is quite light, but it is sufficient to cause some toner pickup in the toning stations in portions not intended to be toned at all. That toner picked up by the oil pattern transfers with the rest of the image to the receiving sheet, and will show up in the background of the next image to be transferred from that portion of the image member, whether it be a simplex or duplex image.

According to a preferred embodiment of the invention, no oil is applied to a fusing roller while fusing the first image in the duplex mode. Previous oiling is allowed to handle offset. With this precaution, a receiving sheet being transported back to pick up a second image has less residual oil to transfer to the transfer drum and does not get on the image member. This will work for a limited number of copies before offset occurs from lack of oil. Thus, this embodiment works well in copiers or printers which have a relatively short duplex return path, for example, a six-sheet return path. With such a return path, a simple algorithm can be used in which no oil is applied for any imaging of the first side in duplex mode. If a longer return path is used, oil can be applied periodically or a smaller amount of oil than normal can be applied continually during the fusing of the first image in duplex.

BEST MODE OF CARRYING OUT THE INVENTION

Figure 1:
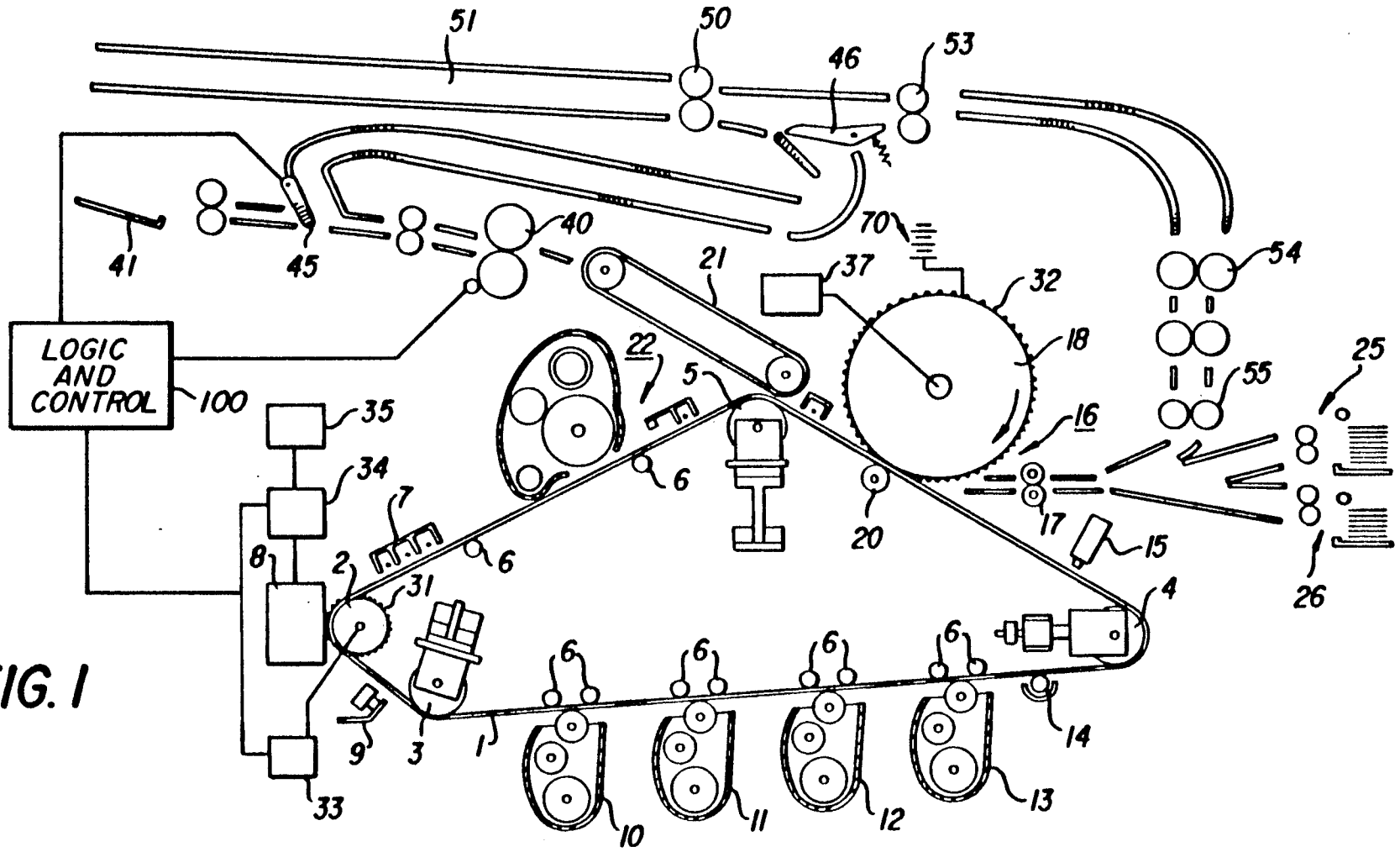
FIG. 1 is a schematic front view of an image-forming apparatus constructed according to the invention, with many parts eliminated for clarity of illustration.

According to FIG. 1 a film core portion of an image-forming apparatus, for example, a copier or printer, includes an image member, for example an endless electrophotoconductive web 1 entrained about a series of primary rollers 2, 3, 4 and 5, and other supporting structure, for example, film skis 6.

Web 1 is driven through a series of electrophotographic stations generally well known in the art. More specifically; a uniform charge is laid down on the web 1 by a charging station 7. The uniformly charged web moves around printhead roller 2 which is directly opposite and LED printhead 8, which LED printhead exposes the web 1 in a manner well known in the art. The web then moves into operative relation with an electrometer 9 which senses the level of a charge existing after exposure of the web by printhead 8, to help control the process.

The web then moves into operative relation with a series of toning or developing stations 10, 11, 12 and 13. Each image created by printhead 8 is toned by one of the toning stations. After being toned, the web passes a magnetic scavenger 14 which removes excess iron particles picked up in the toning process. After the electrostatic image has been toned, the web passes under a densitometer 15 which measures the density of the toner image, also for use in controlling the process. The toner image then proceeds to a transfer station 16 where the image is transferred to a transfer surface of a receiving sheet carried by or backed by a transfer drum 18.

The transfer drum 18 includes vacuum holes (not shown) for securing the receiving sheet thereto for repeated presentations to web 1. Transfer drum 18 cooperates with web 1 to incrementally bring the receiving sheet and the toner image into transfer relation so that the toner image is transferred to the receiving sheet. As is well known in the art, this is generally accomplished in the presence of an electric field which is created by biasing the transfer drum by a suitable biasing means, for example, electrical source 70, compared to the conductive layer of the web 1 or to a backing roller 20 for the web.

When the apparatus is operating in a multi-image mode, for example, a multicolor mode, consecutive images or pairs of images are toned with different color toners using the different toning stations 10–13. These consecutive images are transferred in registration to the receiving sheet as it repeatedly is brought into transfer relation with the web 1 by the drum 18. After the transfer operation is complete, the receiving sheet is allowed to follow the web. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism, all located at cleaning station 22.

The transfer drum 18 is driven by a motor 37. The drum 18, in turn, drives the web 1 through a sprocket 32 which engages perforations in the web. The sprocket 32 also forms part of a registration and timing system which includes a sprocket 31 on printhead roller 2, which sprocket is linked to an encoder 33. The encoder 33 feeds signals indicative of the angular position of sprocket 32 to a drive 34 for the printhead 8 which drive 34 times the application of information from an information source 35 to the printhead 8 all as controlled by a logic and control 100. The logic and control 100 is shown connected to a few of the critical stations but, in fact, controls the entire apparatus.

After the receiving sheet leaves the fuser 40 it can go directly to an output tray 41 or be deflected by a deflector 45 into a duplex path according to the position of deflector 45, the position of which is controlled by logic and control 100. The duplex path moves the sheet by rollers and guides directing it first through a passive deflector 46 to turn around rollers 50. Turn around rollers 50 are independently driven to drive the receiving sheet into a turn around guide means 51 until the trailing edge of the sheet has been sensed by an appropriate sensor, not shown, to have passed passive diverter 46. Once the trailing edge has passed passive diverter 46, the turn around rollers 50 are reversed, and the receiving sheet is driven by rollers 50 and other sets of drive rollers 53 and 54 back to a position upstream of the transfer station 16. The receiving sheet can pass through registration mechanisms for correcting for skew, crosstrack misalignment and intrack misalignment and ultimately stop at alignment rollers 55.

Transfer station 16 receives sheets from any of three sources. First, it can receive sheets of one particular size from a first supply 25, which first supply may include, for example, letter-sized sheets being fed with their short dimension parallel with the direction of feed. Second, it may receive sheets from a second supply 26 which, for example, may include ledger-sized sheets with their long dimension parallel to the direction of feed. Third, it can receive letter and legal-sized sheets with their short dimension in the crosstrack direction from one of supplies 25 and 26. Fourth, the transfer station 16 may receive sheets from the duplex path as controlled by rollers 55 which may include any size sheet and would already contain a fused image on its upper side.

The receiving sheets from whatever source, stop against timing roller 17. In response to a signal from logic and control 100 timing rollers 17 accelerate to drive the receiving sheet into the nip between the transfer drum 18 and the web 1 as the first toner image to be transferred approaches the nip.

The duplex path could include a duplex tray, allowing it to include many sheets. However, in the preferred form of the invention, the duplex path is of a length that takes several sheets at one time depending on the length of the sheets but without a duplex tray. For example, six letter-sized sheets or three ledger-sized sheets may be in the duplex path at one time. If the printer is printing different images on different sheets, the logic and control of the apparatus must supply the necessary programming to the exposure and toning station so that the sheets ultimately fed to the output tray 41 are in the correct order considering the number of sheets that must be in the duplex path. Such programming is known in the art, see, for example, U.S. Pat. No. 4,453,841 to Bobick et al, issued Jun. 12, 1984 and U.S. Pat. No. 4,568,169 to Wada et al, issued Feb. 4, 1986. For multicolor images the programming is more detailed and extensive, but follows the same basic principles. For an extensive discussion of such principles, see *Research Disclosure*, May 1988, No. 28956, pages 305–306, titled *Exposure Scheduling for Improved Frame Utilization and Throughout.*

The drum 18 has an aluminum core and a polyurethane outer layer. Preferably, the polyurethane is of an intermediate conductivity, for example, it may have a resistivity of $5\times10^9$ ohms-cm.

If a single color image is to be transferred to a receiving sheet, it is fed into the nip between the transfer roller image member 1, and no vacuum is applied to the vacuum holes in drum 18. The image is transferred to the receiving sheet, and the receiving sheet stays in contact with web 1 and moves directly to transport device 21.

On the other hand, if multiple images are to be transferred to the receiving sheet, the leading edge of the receiving sheet is gripped by vacuum holes in transfer drum 18 and the receiving sheet is transported repeatedly through transfer relation with image member 1, as described above. In this mode, the transfer drum is large enough to hold two letter-sized sheets with their long dimensions in the crosstrack direction. Thus, two sets of vacuum holes are provided 180° apart on the drum periphery. If a ledger-sized sheet is used, only a single ledger-sized sheet is attached to drum 18 utilizing most of the circumference of the drum. Other size sheets may also receive images. For example, legal-sized and letter-sized sheets may be attached with their short dimensions in the crosstrack direction. Throughput in this mode will be at the ledger-sized rate, one-half the regular letter-sized rate.

To enhance release of the receiving sheet from the transfer drum back to the image member 1 as the last image is transferred, the surface of the transfer drum has been roughened, forming a texture. The texture typically has peaks and valleys separated by between 0.002 and 0.005 inches. For more details of this aspect, see U.S. application Ser. No. 07/430,037, cited above.

Figure 2:
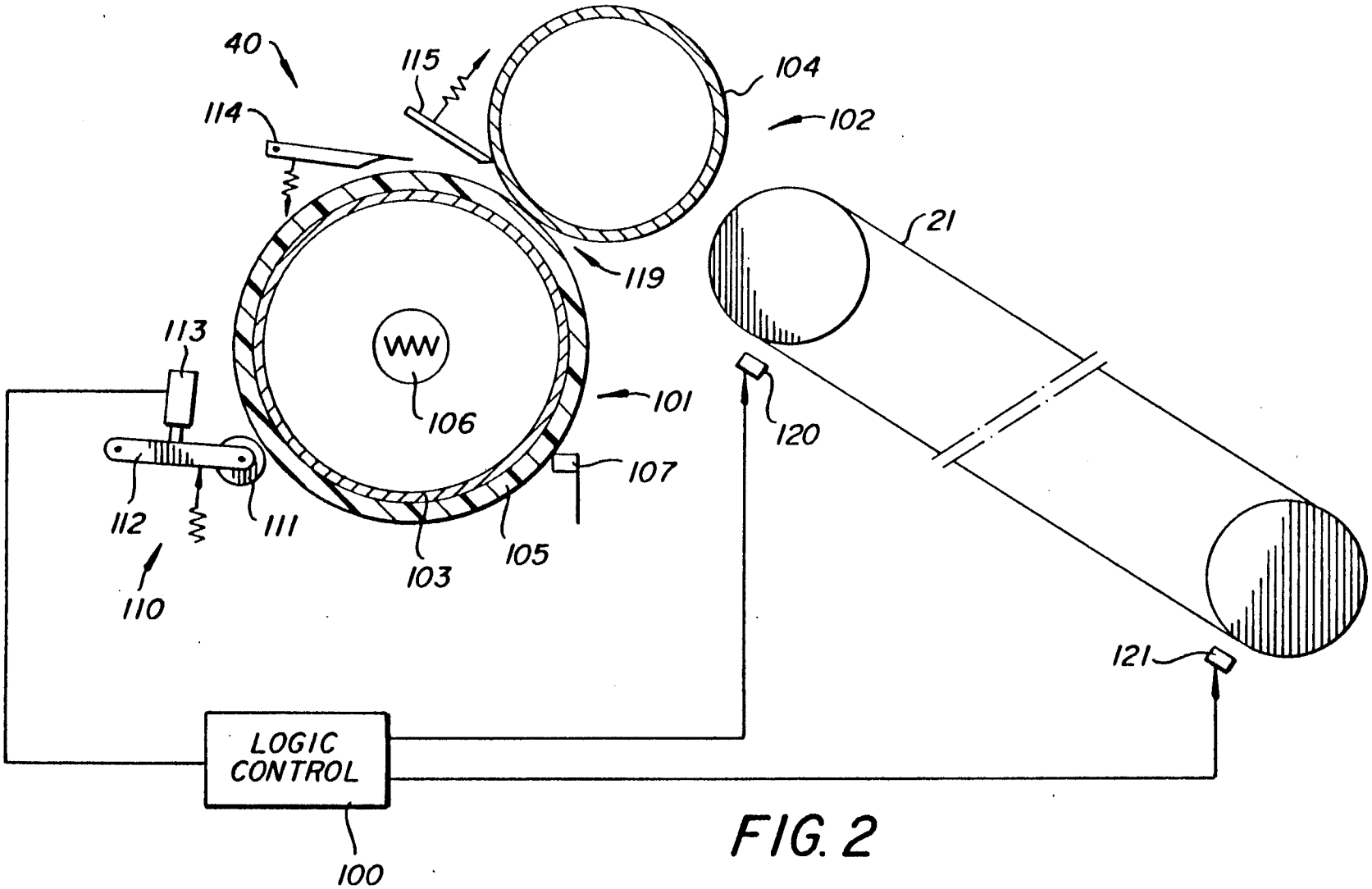
FIG. 2 is a front schematic of the fuser portion of the apparatus shown in FIG. 1, with fusing rollers shown in section.

According to FIG. 2 fuser 40 includes a fusing roller 101 and a pressure roller 102 which are urged together to create a pressure nip 119 into which a receiving sheet is fed. Fusing roller 101 includes a metallic, for example aluminum, core 103 which is covered by a thin silicone rubber layer 105. Layer 105 can be ordinary red silicone rubber of a type commonly used in fusers in a thickness of about 0.1 inches. Roller 101 is internally heated by a lamp 106, but could be externally heated, as is well known in the art. To control the temperature of fusing roller 101 a temperature sensor 107 is positioned either on the surface of rubber layer 105 or on the core 103. Fusing roller 105 can also have other layers, for example, it can be covered with a very thin VITON layer to enhance its wear and release properties. (VITON is a trademark of DuPont used with respect to a heat resistant fluoropolymer.)

Pressure roller 102 can also have an aluminum core 104 and be covered with a very thin layer of a material having good release characteristics, for example TEFLON or SILVERSTONE. (TEFLON and SILVERSTONE are also trademarks of DuPont used with respect to heat resistant fluoropolymers.)

To assure release of a receiving sheet from the fuser as it exits nip 119, a skive 115 is permanently urged into contact with pressure roller 102. Similarly, a skive 114 is positioned to engage fusing roller 101. Skive 114 can be automatically movable into and out of engagement with fusing roller 101 so that it is in position only when needed and does not otherwise wear the fusing roller surface. Both such skives are well known in the art.

Rollers 102 and 101 are held by a conventional yoke mechanism (not shown) which fixes the positions of their shafts with respect to each other. These positions are factory or field adjustable, but are not altered during operation of the apparatus. That is, the rollers are not separated according to whether the machine is in an "off", "standby" or "run" condition. The pressure in nip 119 may vary somewhat according to the temperature of the rollers 101 and 102 due to heat expansion.

Fuser 40 has three conditions. In an "off" condition the rollers are neither rotated nor heated. In a "standby" condition the rollers are heated to a standby temperature and rotated at a slow speed, for example, two inches per second. In a "run" condition the rollers are heated to a run temperature, with setpoints somewhat higher than the standby temperature, and are rotated at a fast speed, for example, 12 inches per second.

Obviously, other conditions could also be used. For example, when fusing color transparencies, the fuser could be run at its slow speed but with the temperature set at its high or run condition.

To prevent offset of toner onto the surface of fusing roller 101 an offset preventing liquid is applied to its surface using a wicking device 110. Wicking device 110 is an internally fed rolling wick similar to that described in U.S. Pat. No. 4,429,990 referred to above, which wick has been used commercially for a number of years. See also U.S. Pat. No. 4,908,670 to Ndebi, issued Mar. 13, 1990, for a description of another rolling wick usable in this process. Wicking device 110 includes a wick 111 having an internal feed tube to which oil is fed from a reservoir through a pump (not shown). The internal feed tube feeds liquid according to its pumping pressure, which liquid is distributed through a porous ceramic to an exterior wicking material, commonly wool or a synthetic heat resistant wicking material. Rolling wick 111 is supported on an arm or yoke 112 which is rotatable about a pivot by a solenoid 113 to move the wick 111 into and out of engagement with the surface of roller 101. Movement of wick 111 by solenoid 113 is controlled by logic and control 100 according to an algorithm which provides optimum oiling with various types of jobs run by the image-forming apparatus. That movement can be controlled by appropriate sensors which determine the actual position of wick 111 to appropriately signal logic and control 100 to shut the apparatus down or signal the operator when the wick is not in a desired position.

Logic and control 100 contains information with respect to the job stream being handled by the apparatus which permits control of fuser 40 and diverter 45 as well as the rest of the apparatus, including rollers 17, the vacuum on transfer drum 18 and the like.

Utilizing this apparatus in a mixture of its simplex and duplex modes, some images were discovered to have an unacceptably high amount of toner in background areas that were intended to be free of toner. This unacceptably high amount of toner was observed to be somewhat patterned. After investigation we determined that the pattern was consistent with the pattern of the roughened surface of transfer drum 18. We theorized that the pattern was the result of fusing oil being fed back through the system to the surface of transfer drum 18 by duplex receiving sheets and being passed to image member 1 when those surfaces are in contact without paper between them. This oil on image member 1 ultimately picks up a small amount of toner while passing through toning stations 10, 11, 12 or 13, which toner is invisible in the image areas but is quite visible and objectionable in the background areas. This defect occurred in both simplex and duplex copies that were made after a duplex run.

Our solution to this problem is an algorithm for applying oil to roller 101 which involves considerably less or no oil being applied to roller 101 that will transfer to the sides of receiving sheets carrying the first image in a duplex run. In the most straight forward form of this algorithm, wick 111 is lowered away from roller 101 for the portion of roller 101 that contacts the first image side on a receiving sheet that will receive duplex images.

Control of oiling is accomplished with the assistance of a pair of sensors 120 and 121. Sensors 120 and 121 optically (or mechanically) sense the leading edge of a receiving sheet being carried by transport 21. When no sheet is in or approaching the fuser, wick 111 is usually in a lowered condition away from roller 101.

When the leading edge of a normal letter-sized simplex receiving sheet is sensed by sensor 120, a signal is sent by logic and control 100 to solenoid 113 to raise wick 111 into contact with roller 101. Sensor 120 is positioned upstream from the nip 119 an amount equal to the distance around roller 101 from the nip 119 to wick 111 plus a short distance to accommodate for the time it takes to engage wick 111 with roller 101. Thus, oil arrives in the nip at exactly the same time the leading edge of the simplex receiving sheet arrives. If another sheet is following immediately behind the first sheet, as sensed by sensor 120, the wick is not raised but is kept in contact.

If, on the other hand, logic and control 100 indicates that the sheet sensed at sensor 120 is the first side of a duplex sheet (side 1), then wick 111 is disengaged at this point. Toner does not offset onto roller 101 because of oil remaining on the surface of roller 101 from previous oiling. The duplex path shown in FIG. 1 can handle only six letter-sized sheets. With the materials used for the fusers shown in FIG. 2, six consecutive images can ordinarily be fused without oiling.

After six duplex sheets have been fused without oiling, the next six sheets will be the same six sheets but with the second (opposite) side containing a loose toner image and facing downward to be fused by fusing roller 101. When the leading edge of such duplex sheets, with side 2 facing downward, reaches sensor 120, wick 111 is engaged with roller 101 as though the sheets were simplex sheets.

Following this wicking algorithm we have found that oil does not work its way back into the transfer station and that the background problem that had been observed is eliminated.

Sensor 121 is one frame upstream of sensor 120. If one or more frames without sheets have occurred in the receiving sheet path or the sheets passing through have not been wicked for other reasons, explained below, and the wick has, therefore, been not engaged for a period, it may be too dry to handle six straight duplex side 1's in which it is not oiled. For that reason, if a duplex side 2 reaches sensor 121 and if the wick is not already engaged, then the wick should be engaged for that frame preceding the duplex side 1. The rest of the algorithm would then be followed with all of the duplex side 1's not involving engagement of the wick.

The apparatus shown in FIG. 1 is also capable of forming images on receiving sheets that are shorter in the crosstrack direction than are ordinary letter or ledger-sized sheets. For example, legal or letter-sized sheets which can be imaged with their short dimensions in the crosstrack direction and thus use only 8½ inches of what is normally an 11 inch crosstrack image dimension. It is important to prevent a buildup of oil on both fusing roller 101 and pressure roller 102 in this extra 2½ inches of the image area. Such a buildup would cause uneven absorption of oil across the rollers and can stain the next full-sized sheet to be fused as well as affect the life of the fusing roller. Accordingly, a different oiling algorithm is used for such sheets that are short in the crosstrack direction. According to that algorithm, short sheets are not wicked. If consecutive non-oiled sheets exceeds six, then the wick is engaged for one sheet.

If an error forces the image-forming portion of the apparatus into a complete shutdown state, the fuser roller is changed to its slow speed and the wick oil pump is turned off. The wick is separated from the roller 101 after the last sheet has exited the machine.

Skive 114 is adjusted in timed relation to sensing of the leading edge of a sheet by sensor 120. When logic and control receives a signal that the leading edge of a sheet is passing sensor 120, logic and control waits a given amount of time, allowing the leading edge to reach the fusing nip and then actuates the control for skive 114 to move it into a down or active condition against roller 101. Skive 114 is raised after a short down period sufficient to separate the receiving sheet, if necessary, from roller 101. Skive 114 also should be lowered to its active position for a longer period of time after a hard shutdown to assure that no sheets wrap around the fusing roller while the fuser is turning at its slow speed. The same timing would be desirable if a transparency is being fused at a slow speed.

The operation of fuser 40 has been described with sensors 120 and 121 providing location information with respect to sheets approaching the fuser. However, they can be eliminated and their presence simulated by modern machine logic and control based on the overall timing of the apparatus including the original copy feeding.

It is common in fusers of this type to separate the rollers when the fuser is not being used to prevent heat set of the softer roller. However, the contraction of the rollers as they cool when the apparatus is shut down, reduces the pressure somewhat at the point of contact. Although some set does appear to take affect in the roller 101 when it is started up again, that set appears to work its way out as the fuser is run at its slow speed during warm-up. This fuser thus has the distinct advantage of not requiring the separating mechanism. The device can be relatively simple in construction and considerably more reliable.

Image-forming apparatus are known with a duplex tray in a duplex return path which can hold, for example, 50 or 100 sheets. Such apparatus does not lend itself to the specific wicking algorithm of the preferred embodiment since the fuser would need to be oiled during a long first side duplex run to prevent offset. However, the algorithm could be used by intermittent oiling during a first side run. Alternatively, less oil could be applied for all first side fusing, which less oil would be chosen to just prevent offset. U.S. Pat. No. 4,942,433 describes a method of applying less oil during a portion of a run using a rolling wick.

The algorithm suggested herein is not limited to use with a rolling wick, but could also be used with other oil applying mechanisms, for example, those shown in U.S. Pat. Nos. 4,549,803 and 4,593,992.

The invention has been described in detail with particular reference to a preferred embodiment thereof, but it will be understood that variations and modifications can be effected within the spirit and scope of the invention as described hereinabove and as defined in the appended claims.

We claim:

1. An image-forming apparatus comprising:

an image member movable through an endless path, means for forming a plurality of electrostatic images, one after another on said image member, means for applying toner to said images to form a plurality of toner images one after another on said image member corresponding to said electrostatic images, means for transferring at least one of said toner images to a first side of a receiving sheet, which receiving sheet has first and second sides, means for fixing a transferred image to said receiving sheet, means for feeding said receiving sheet from said fixing means back to said transfer means for presenting the second side of said receiving sheet to said image member for transfer of at least a second toner image to said second side, characterized in that said fixing means includes means defining a fusing surface which contacts an image to be fixed, means for applying oil to said surface, means for adjusting said oil-applying means between a normal first condition in which oil is applied to said surface and a second condition in which oil is either not applied to said surface or a reduced amount of oil is applied to said surface, and logic and control means for controlling said adjusting means so that it is in its second condition when fixing images on the first side of a receiving sheet which is to receive an image on its second side.

2. Image-forming apparatus according to claim 1 wherein said logic and control means controls said adjusting means to place said adjusting means in its first condition when said receiving sheet is to receive an image only on its first side or when fusing an image on the second side of a receiving sheet already having an image on the first side.

3. Image-forming apparatus according to claim 1 wherein said transfer means includes a transfer drum that engages a side of a receiving sheet opposite said image member when an image is being transferred to said sheet and engages said image member when no receiving sheet is in said transfer means.

4. Image-forming apparatus of claim 1 wherein said logic and control includes means for controlling said adjusting means to its first condition for a predetermined time immediately prior fixing one or more images on the first side of a receiving sheet which is to receive an image in its second side.

5. An image-forming apparatus including:

means for forming a plurality of toner images on an image member, means for transferring each of said toner images to a receiving sheet, means for fusing a toner image to a receiving sheet, said fusing means having a heated roller which contacts the image to be fused and means for applying oil to said roller, said oil applying means having a first condition in which a normal amount of oil is applied to said roller and a second condition in which less or no oil is applied to said roller, respectively, means for feeding a receiving sheet along a path from said transfer means to said fusing means and back to said transfer means, said apparatus having a simplex mode in which images are transferred to one side of a receiving sheet and are not fed back to said transfer means after passing through said fusing means and a duplex mode in which an image is transferred to a first side of a receiving sheet and the sheet is fed back after passing through the fusing means to the transfer means where an image is transferred to a second opposite side of said sheet, and logic and control means for adjusting said oil-applying means to its second condition when the first image is being fused in the duplex mode and to its first condition when the second image is being fused in the duplex mode and when the apparatus is in the simplex mode.

6. Image-forming apparatus according to claim 5 wherein said logic and control also includes means for adjusting said oil-applying means to its first condition for a short period of operation before receiving a receiving sheet having a first image when said receiving sheet is in the duplex mode.

7. Image-forming apparatus according to claim 6 including means for sensing a leading edge of a receiving sheet as it approaches said fusing device at a position in timed relation to the oil-applying means and a second sensor for sensing the arrival of the leading edge of a receiving sheet one image frame upstream of said first sensor, said logic and control means including means for adjusting said oil-applying means to its first condition if a receiving sheet having an image on a first side in the duplex mode is sensed at said second sensor and no receiving sheet is sensed at said first sensor.

8. An image-forming apparatus comprising:

an image member movable through an endless path, means for forming a series of electrostatic images, one after another on said image member, means for applying toner of different colors to said images to form a series of different color toner images on said image member, a transfer drum positioned in contact with said image member and rotatable to move with said image member, means for feeding a receiving sheet into contact with said transfer drum, said transfer drum including means for securing said receiving sheet to its periphery for repeated presentation to said image member to receive said toner images on said receiving sheet in registration to form a multicolor image, said receiving sheet having first and second sides, means for fixing a transferred image to said receiving sheet, means for transporting said receiving sheet from said transfer drum to said fixing means, means for transporting said receiving sheet from said fixing means back to said transfer drum to receive one or more toner images on its second side, characterized in that said fixing means includes means defining a fusing surface which contacts an image to be fixed, means for applying oil to said surface, means for adjusting said oil applying means between a normal first condition in which oil is applied to said surface and a second condition in which oil is either not applied to said surface or a reduced amount of oil is applied to said surface, and logic and control means for controlling said adjusting means so that it is in its second condition when fixing images on the first side of a receiving sheet which is to receive an image on its second side.

9. Image-forming apparatus according to claim 8 wherein said apparatus is adapted to transfer images to a receiving sheet having a variety of crosstrack dimensions including a normal dimension and one or more narrow dimensions, narrower than said normal dimensions, and wherein said logic and control means includes means for controlling said adjusting means so that it is in its second condition when fixing images on a receiving sheet having a narrow crosstrack dimension.

10. Image-forming apparatus according to claim 8 wherein said logic and control means controls said adjusting means to place said adjusting means in its first condition when said receiving sheet is to receive only one image or when fusing an image on the second side of a receiving sheet already having an image on its first side.

11. Image-forming apparatus according to claim 8 wherein said transfer drum has a peripheral surface which has been roughened.

12. Image-forming apparatus according to claim 8 wherein said image member is an endless belt entrained about a series of rollers.

13. An image-forming apparatus comprising:

means for forming a plurality of toner images on an image member, means for transferring each of said toner images to a receiving sheet, means for fusing an image to a receiving sheet, said fusing means having a heated roller which contacts the image to be fused and means for applying oil to said roller, said oil applying means having a first condition in which a normal amount of oil is applied to said roller and a second condition which less or no oil is applied to said roller, respectively, means for feeding a receiving sheet along a path from said transfer means to said fusing means, means for transporting a receiving sheet along a duplex path from said fusing means back to said transfer means, which duplex path does not have a tray or other means for storing receiving sheets being transported back to said transfer means, but has a limited length capable of taking limited finite number of sheets at one time, said apparatus having a simplex mode in which images are transferred to one side of a receiving sheet and are not transported back to said transfer means after passing through said fusing means and a duplex mode in which an image is transferred to a first side of a receiving sheet and the sheet is fed back after passing through the fusing means to the transfer means where an image is transferred to a second opposite side of said sheet, and logic and control means for adjusting said oil applying means to its second condition when the first image is being fused in the duplex mode and to its first condition when the second image is being fused in the duplex mode and when the apparatus is in the simplex mode.

* * * * *